US007898483B2

(12) United States Patent
Chen et al.

(10) Patent No.: US 7,898,483 B2
(45) Date of Patent: Mar. 1, 2011

(54) DIGITAL TV ANTENNA

(75) Inventors: Yen-Yu Chen, Chung Ho (TW); Yung-Da Lin, Chung Ho (TW); Kuo-Ying Su, Chung Ho (TW)

(73) Assignee: Avermedia Technology, Inc., Chung Ho, Taipei Hsien (TW)

( * ) Notice: Subject to any disclaimer, the term of this patent is extended or adjusted under 35 U.S.C. 154(b) by 375 days.

(21) Appl. No.: 12/254,120

(22) Filed: Oct. 20, 2008

(65) Prior Publication Data

US 2010/0026581 A1 Feb. 4, 2010

(30) Foreign Application Priority Data

Jul. 31, 2008 (TW) ..... 97129120 A

(51) Int. Cl.
*H01Q 1/38* (2006.01)

(52) U.S. Cl. ..... 343/700 MS; 343/893

(58) Field of Classification Search ..... 343/828, 343/848, 770, 786, 711, 772, 791, 792.5, 343/771, 795, 895, 713, 767, 702, 700 MS; 174/2, 33, 36; 333/204, 247, 238; 361/118, 361/302, 816
See application file for complete search history.

(56) References Cited

U.S. PATENT DOCUMENTS

| | | | | |
|---|---|---|---|---|
| 7,768,400 | B2 * | 8/2010 | Lawrence et al. | 340/572.1 |
| 2004/0246180 | A1 | 12/2004 | Okado | |
| 2007/0046544 | A1 * | 3/2007 | Murofushi et al. | 343/700 MS |
| 2008/0143607 | A1 * | 6/2008 | Jung et al. | 343/700 MS |
| 2008/0246668 | A1 * | 10/2008 | Qi et al. | 343/702 |
| 2009/0121943 | A1 * | 5/2009 | Tinsley et al. | 343/700 MS |

FOREIGN PATENT DOCUMENTS

| | | |
|---|---|---|
| FR | 2888675 | 1/2007 |
| WO | WO 9930385 | 6/1999 |

OTHER PUBLICATIONS

English language translation of abstract of FR 2888675.

* cited by examiner

*Primary Examiner* — Douglas W Owens
*Assistant Examiner* — Jae K Kim
(74) *Attorney, Agent, or Firm* — Thomas, Kayden, Horstemeyer & Risley, LLP

(57) ABSTRACT

A digital TV antenna includes a grounding plane, a first radiation conductor, a second radiation conductor and a third radiation conductor. The grounding plane and the first radiation conductor are located in the first surface of a substrate. The second radiation conductor and the third radiation conductor are located in the second surface opposite to the first surface. Partial second radiation conductor covers the first radiation conductor to form an overlapping region. Partial third radiation conductor covers the first radiation conductor to form an overlapping region.

20 Claims, 5 Drawing Sheets

DIGITAL TV ANTENNA

RELATED APPLICATIONS

This application claims priority to Taiwan Application Serial Number 97129120, filed Jul. 31, 2008, which is herein incorporated by reference.

FIELD OF THE INVENTION

The present invention relates to an antenna apparatus, and especially to an antenna apparatus for receiving digital TV signals.

BACKGROUND OF THE INVENTION

The key development in communication technology has been the transfer from wired to wireless communication, especially in the field of propagating digital TV signals. The signal propagates through the air in the form of electromagnetic waves, where the bridge of the signals between the wireless unit and the air is an antenna. That is to say, wireless communication units need antennas to transmit or receive electromagnetic waves, and they are therefore essential components of wireless communication units.

The typical antenna used in the digital TV field is helical antenna. Although the structure of the helical antenna is simple, the bandwidth and the radiation efficiency of the helical antenna are not enough for the propagating digital TV signal.

Therefore, an improved antenna is desired to overcome the above-mentioned shortcomings of existing antennas.

SUMMARY OF THE INVENTION

Therefore, the main purpose of the present invention is to provide a digital TV antenna with a wide bandwidth and high radiation efficiency.

In accordance with the foregoing purpose, the present invention discloses a digital TV antenna located in a substrate. The substrate has a first surface and a second surface opposite to the first surface. The digital TV antenna includes a grounding plane, a first radiation conductor, a second radiation conductor and a third radiation conductor. The grounding plane located in the first surface. The grounding place has a main grounding plane with a grounding terminal and an extended grounding plane extending from the main grounding plane. The first radiation conductor located in the first surface. The first radiation conductor with a feeding terminal has a first side and a second side opposite to the first side. The first radiation conductor couples with the grounding plane. A predetermined distance exists between the first side and the extended grounding plane. A second radiation conductor located in the second surface couples with the first radiation conductor. Partial second radiation conductor crosses the first side for a first distance to cover the first radiation conductor to form an overlapping region. A third radiation conductor located in the second surface couples with the second radiation conductor. Partial third radiation conductor crosses the second side for a second distance to cover the first radiation conductor to form an overlapping region.

In an embodiment, the first distance is at least 1 mm. The second distance is at least 0.2 mm.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
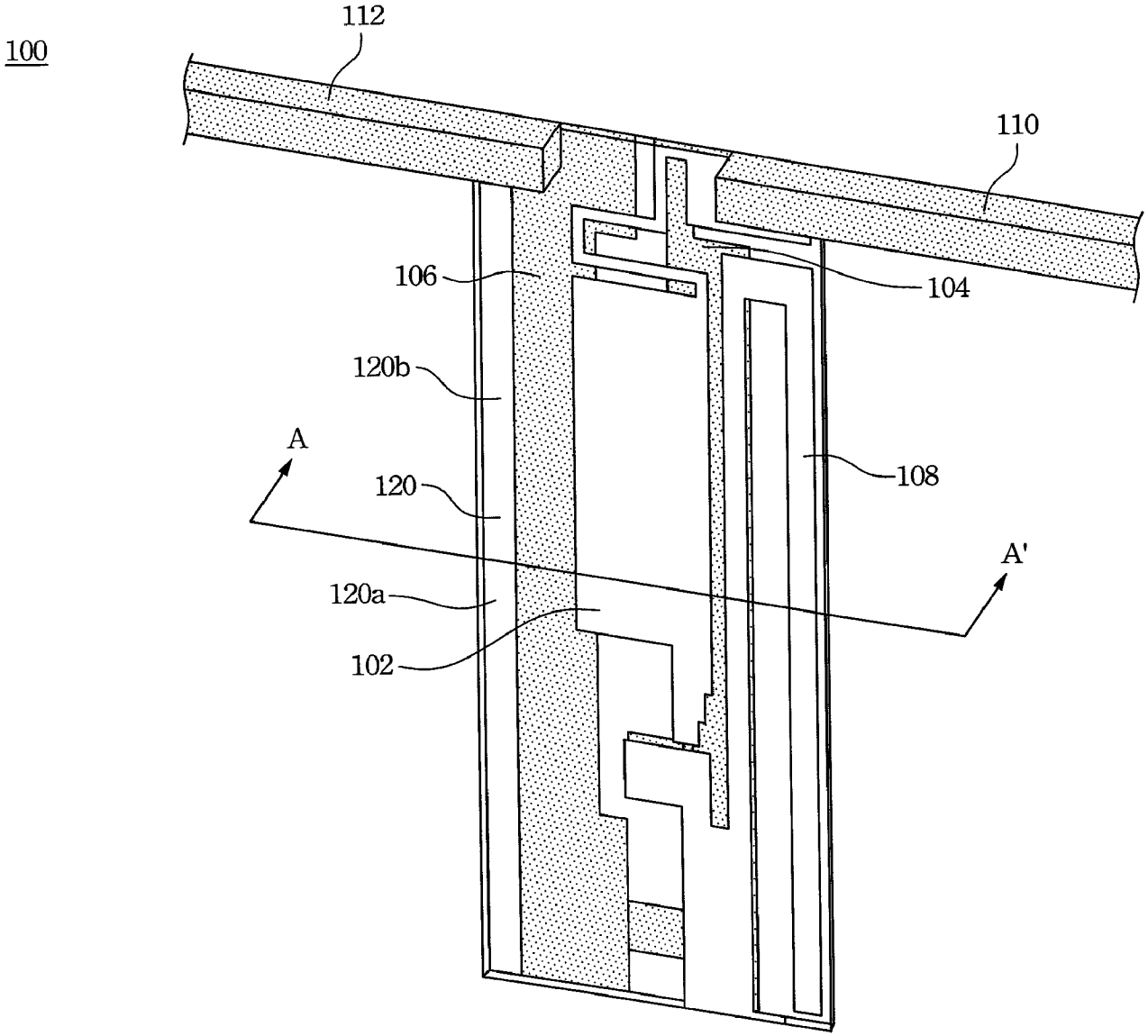
FIG. 1 is a schematic perspective diagram of a digital TV antenna according to an embodiment.

FIG. 1 is a schematic perspective diagram of a digital TV antenna according to an embodiment. The digital TV antenna 100 is located on the first surface 120*a* and the second surface 120*b* opposite to the first surface 120*a* of a dielectric substrate 120. The digital TV antenna receives frequencies in the range from 470 MHz to 870 MHz.

The digital TV antenna 100 includes three radiation conductors and a grounding plane 108. The three radiation conductors are the first radiation conductor 102, the second radiation conductor 104 and the third radiation conductor 106. The first radiation conductor 102 and the grounding plane 108 are located in the first surface 120*a* of the substrate 120. The second radiation conductor 104 and the third radiation conductor 106 locate in the second surface 120*b* of the substrate 120. It is noticed that a perspective substrate is illustrated in the FIG. 1 so as to present the second radiation conductor 104 and the third radiation conductor 106 partially overlap the first radiation conductor 102. One end of the first radiation conductor 102 connects with couples a first extended metal arm 110. One end of the third radiation conductor connects with a second extended metal arm 112.

Figures 2, 3, 4:
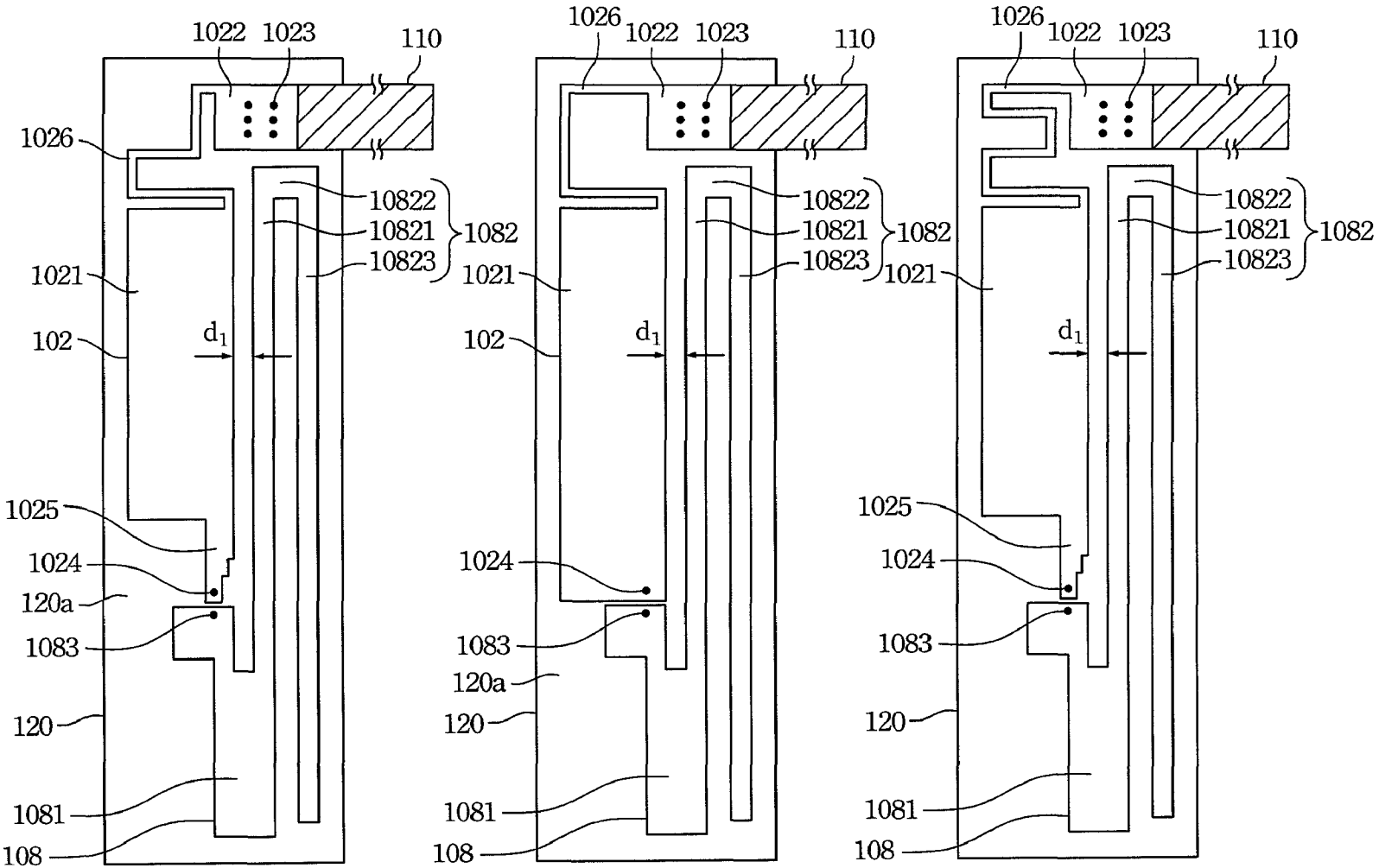
FIG. 2 is a schematic diagram of a first radiation conductor and a grounding plane according to the first embodiment.
FIG. 3 is a schematic diagram of a first radiation conductor and a grounding plane according to the second embodiment.
FIG. 4 is a schematic diagram of a first radiation conductor and a grounding plane according to the third embodiment.

FIG. 2 is a schematic diagram of a first radiation conductor and a grounding plane according to the first embodiment. The first radiation conductor 102 and the grounding plane 108 are located in the first surface 120*a* of the substrate 120.

The grounding plane 108 includes a main grounding plane 1081 and an extended grounding plane 1082 extending from the main grounding plane 1081. A grounding terminal 1083 is in the main grounding plane 1081. The extended grounding plane 1082 has a bended appearance. In an embodiment, the extended grounding plane 1082 includes a first extended segment 10821, a second extended segment 10822 and a third extended segment 10823. The three extended segments have a reversed "U" appearance. In other embodiments, different appearances of the three extended segments also can be used in the present invention.

The first radiation conductor 102 includes a main radiation segment 1021 and a connecting segment 1022. The main radiation segment 1021 and the first extended segment 10821 are arranged in parallel to each other and a predetermined distance d1 exists between them. In an embodiment, the predetermined distance d1 is 0.8 mm. In other embodiments, the predetermined distance is changeable based on the antenna design. A feeding terminal 1024 is located in a side of the main radiation segment 1021. In an embodiment, a step metal arm 1025 is extended from a side of the main radiation segment 1021 near the main grounding plane 1081 to make the feeding terminal 1024 and the grounding terminal 1083 be close. The connecting segment 1022 and the second extended segment 10822 are arranged in parallel to each other. A through hole 1023 passing through the substrate 120 is formed in the connecting segment 1022. The first radiation conductor 102 and the second radiation conductor 104 are connected together through the through hole 1023. In an embodiment, a metal arm 1026 whose arm width is 0.8 mm is extended from a side of the main radiation segment 1021 to connect with the connecting segment 1022. The operation frequency and wavelength of an antenna are related to the length and the area of this antenna. Therefore, the bandwidth of the antenna is designated by changing the length or area of the metal arm 1026.

FIG. 3 and FIG. 4 illustrate different structures for the metal arm 1026. In FIG. 3, the main radiation segment 1021 is a rectangular metal plate. The feeding terminal 1024 located in a side of the main radiation segment 1021 near the main grounding plane 1081. In other words, the step metal arm 1025 is not needed in this embodiment. It is noticed that the embodiment does not limit the appearance of the metal arm 1026 and the main radiation segment 1021 in practice. The connecting segment 1022 connects with a first extended metal arm 110. This first extended metal arm 110 is an extension antenna. The length of the extension antenna is less than 130 mm. In an embodiment, the feeding terminal 1024 and the grounding terminal 1083 connect with a coaxial cable (not shown in the figure). The feeding terminal 1024 connects with the inner copper core of the coaxial cable. The grounding terminal 1083 connects with copper screen of the coaxial cable.

Figures 5, 6, 7:
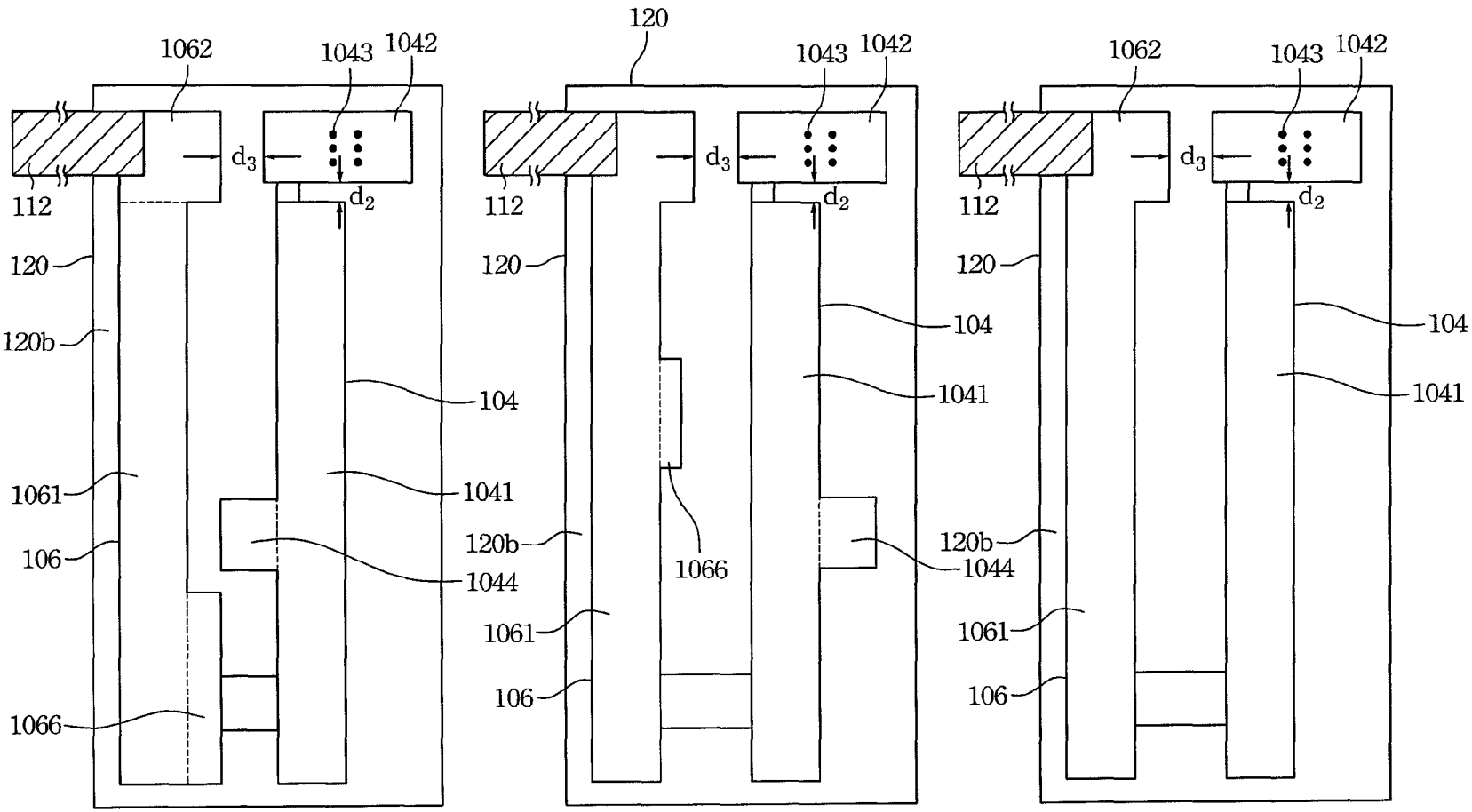
FIG. 5 is a schematic diagram of a second radiation conductor and a third radiation conductor according to the first embodiment.
FIG. 6 is a schematic diagram of a second radiation conductor and a third radiation conductor according to the second embodiment.
FIG. 7 is a schematic diagram of a second radiation conductor and a third radiation conductor according to the third embodiment.

FIG. 5 is a schematic diagram of a second radiation conductor and a third radiation conductor according to the first embodiment. The second radiation conductor 104 and the third radiation conductor 106 located in the second surface 120*b* of the substrate 120.

The second radiation conductor 104 includes a main radiation segment 1041 and a connecting segment 1042. The main radiation segment 1041 has a strip appearance. The connecting segment 1042 is extended from a side of the main radiation segment 1041 and is arranged in the side. A predetermined distance d2 exists between the connecting segment 1042 and the side. In an embodiment, the predetermined distance d2 is 1.5 mm. The embodiment does not limit the predetermined distance d2 in practice. A through hole 1023 passing through the substrate 120 is formed in the connecting segment 1042. The first radiation conductor 102 and the second radiation conductor 104 are connected together through the through hole 1023. The operation frequency and wavelength of an antenna are related to the length and the area of this antenna. Therefore, a bump 1044 is added in a side, such as the side near the third radiation conductor, of the main radiation segment 1041 to change its area to adjust the operation frequency and wavelength. It is noticed that the embodiment does not limit the added location of the bump 1044 in practice. For example, in FIG. 6, the bump 1044 is added in a side of the main radiation segment 1041 opposite to the side near the third radiation conductor. In other embodiment, no bump is added in the second radiation conductor 104 as illustrated in the FIG. 7.

The third radiation conductor 106 includes a main radiation segment 1061 and a connecting segment 1062. The main radiation segment 1061 has a strip appearance. The main radiation segment 1061 is arranged to and connects with a side of the second radiation conductor 104. The connecting segment 1062 connects a side of the main radiation segment 1061. The connecting segments 1062 and 1042 are arranged in parallel to each other and a predetermined distance d3 exists between them. In an embodiment, the predetermined distance d3 is 1.3 mm. The embodiment does not limit the predetermined distance d3 in practice. The connecting segment 1062 connects with a second extended metal arm 112. This first extended metal arm 112 is an extension antenna. The length of the extension antenna 112 is less than 130 mm. The operation frequency and wavelength of an antenna are related to the length and the area of this antenna. Therefore, a bump 1066 is added in a side of the main radiation segment 1061 to change its area to adjust the operation frequency and wavelength. It is noticed that the embodiment does not limit the added location of the bump 1066 in practice. For example, in FIG. 6, the bump 1066 is added in a side of the main radiation segment 1061 near the second radiation conductor 104. In other embodiment, no bump is added in the third radiation conductor 106 as illustrated in the FIG. 7.

Figure 8:
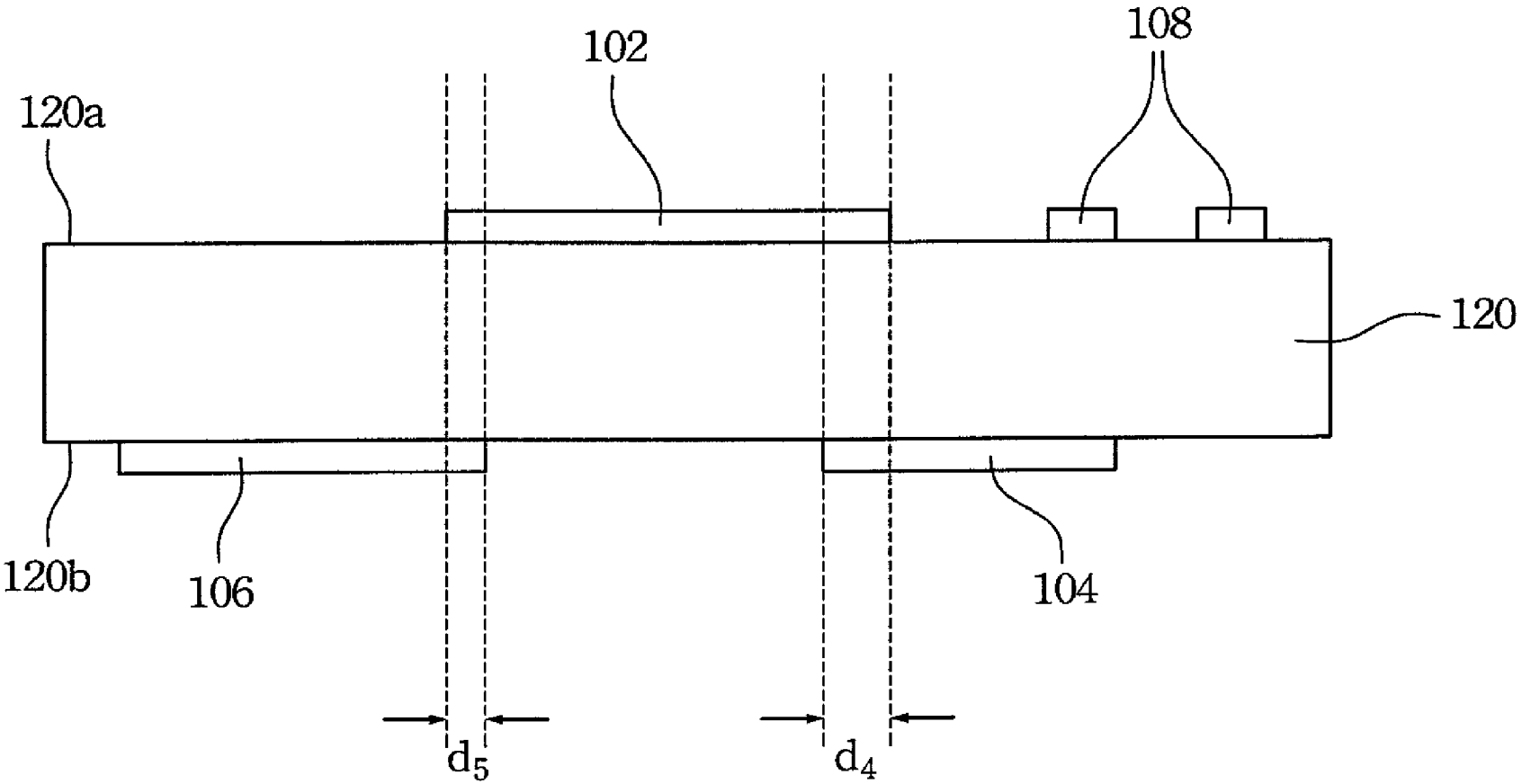
FIG. 8 is a cross-section view along AA' line in the FIG. 1.

FIG. 8 is a cross-section view along AA' line in the FIG. 1. According to the present invention, the second radiation conductor 104 in the second surface 102*b* partially overlaps a side of the first radiation conductor 102 near the grounding plane 108 in the first surface 120*a*. In an embodiment, the width d4 of the second radiation conductor 104 overlapping the first radiation conductor 102 is larger than 0.6 mm, and preferred between 0.6 mm~3.6 mm. Moreover, the third radiation conductor 106 in the second surface 102*b* partially overlaps another side of the first radiation conductor 102 in the first surface 120*a*. In an embodiment, the width d5 of the third radiation conductor 106 overlapping the first radiation conductor 102 is larger than 0.2 mm, and preferred between 0.2 mm~3.6 mm. The resonant frequency is changeable by adjusting the overlapping area between the second radiation conductor 104 and the first radiation conductor 102 and between the third radiation conductor 106 and the first radiation conductor 102.

Figure 9:
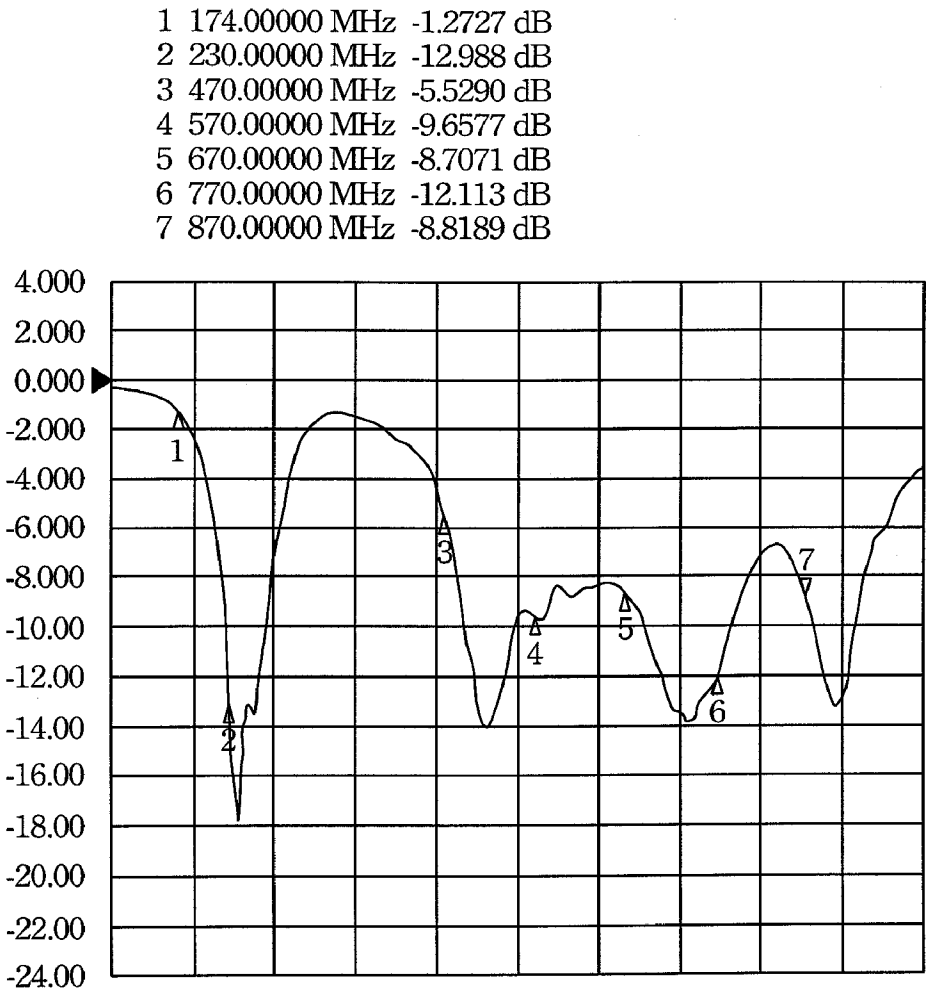
FIG. 9 is a test chart of return loss for the Digital TV antenna of the present invention.

FIG. 9 is a test chart of return loss for the Digital TV antenna of the present invention. The return loss is over 6 dB between the range from 470 MHz to 870 MHz.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A digital TV antenna, wherein the digital TV antenna is located on a substrate, the substrate has a first surface and a second surface opposite to the first surface, comprising:

a grounding plane located on the first surface, wherein the grounding plane has a main grounding plane with a grounding terminal and an extended grounding plane extending from the main grounding plane;

a first radiation conductor located on the first surface, the first radiation conductor with a feeding terminal has a first side and a second side opposite to the first side, the first radiation conductor couples with the grounding plane and a predetermined distance exists between the first side and the extended grounding plane;

a second radiation conductor located on the second surface and coupling with the first radiation conductor, wherein partial second radiation conductor crosses the first side for a first distance to overlap the first radiation conductor to form an overlapping region, wherein the first distance is at least 0.6 mm; and a third radiation conductor located on the second surface and coupling with the second radiation conductor, wherein partial third radiation conductor crosses the second side for a second distance to overlap the first radiation conductor to form an overlapping region, wherein the second distance is at least 0.2 mm.

2. The digital TV antenna of claim 1, wherein the first radiation conductor, the second radiation conductor and the third radiation conductor receive frequencies in the range from 470 MHz to 870 MHz.

3. The digital TV antenna of claim 1, wherein the first distance is between 0.6 mm~3.6 mm, the second distance is between 0.2 mm~3.6 mm.

4. The digital TV antenna of claim 1, further comprising a first extended metal arm coupling with the first radiation conductor, wherein the length of the first extended metal arm is less than 130 mm, and a second extended metal arm coupling with the third radiation conductor, wherein the length of the second extended metal arm is less than 130 mm.

5. The digital TV antenna of claim 1, wherein the predetermined distance is 0.8 mm and the extended grounding plane has a first extended segment, a second extended segment and a third extended segment to constitute a reversed "U" appearance.

6. The digital TV antenna of claim 5, wherein a through hole passing through the substrate is formed in the first connecting segment, the first radiation conductor connects with the second radiation conductor through the through hole.

7. The digital TV antenna of claim 1, wherein the second radiation conductor includes a second main radiation segment and a second connecting segment, wherein the second connecting segment is extended from the second main radiation segment.

8. The digital TV antenna of claim 1, wherein a bump is extended from the second radiation conductor to adjust the operation frequency of the second radiation conductor.

9. The digital TV antenna of claim 1, wherein a bump is extended from the third radiation conductor to adjust the operation frequency of the third radiation conductor.

10. A digital TV antenna, wherein the digital TV antenna is located on a substrate, the substrate has a first surface and a second surface opposite to the first surface, comprising:

a grounding plane located on the first surface, wherein the grounding plane has a main grounding plane with a grounding terminal and an extended grounding plane extending from the main grounding plane, the extended grounding plane has a reversed "U" appearance;

a first radiation conductor located on the first surface, the first radiation conductor with a feeding terminal has a first side and a second side opposite to the first side, the first radiation conductor couples with the grounding plane and a predetermined distance exists between the first side and the extended grounding plane;

a first extended metal arm coupling with the first radiation conductor;

a second radiation conductor located on the second surface and coupled with the first radiation conductor, wherein partial second radiation conductor crosses the first side for a first distance to overlap the first radiation conductor to form an overlapping region, wherein the first distance is at least 0.6 mm;

a third radiation conductor located on the second surface and coupling with the second radiation conductor, wherein partial third radiation conductor crosses the second side for a second distance to overlap the first radiation conductor to form an overlapping region, wherein the second distance is at least 0.2 mm; and a second extended metal arm coupling with the third radiation conductor.

11. The digital TV antenna of claim 10, wherein the first radiation conductor, the second radiation conductor and the third radiation conductor receive frequencies in the range from 470 MHz to 870 MHz.

12. The digital TV antenna of claim 10, wherein the first distance is between 0.6 mm~3.6 mm, the second distance is between 0.2 mm~3.6 mm.

13. The digital TV antenna of claim 10, wherein the length of the first extended metal arm is less than 130 mm and the length of the second extended metal arm is less than 130 mm.

14. The digital TV antenna of claim 10, wherein the extended grounding plane has a first extended segment, a second extended segment and a third extended segment to constitute a reversed "U" appearance.

15. The digital TV antenna of claim 14, wherein the first radiation conductor includes a first main radiation segment and a first connecting segment, wherein the first main radiation segment is arranged in a side of the first extended segment and the first connecting segment is arranged in a side of the second extended segment.

16. The digital TV antenna of claim 15, wherein a through hole passing through the substrate is formed in the first connecting segment, the first radiation conductor connects with the second radiation conductor through the through hole.

17. The digital TV antenna of claim 10, wherein the predetermined distance is 0.8 mm.

18. The digital TV antenna of claim 10, wherein the second radiation conductor includes a second main radiation segment and a second connecting segment, wherein the second connecting segment is extended from the second main radiation segment.

19. The digital TV antenna of claim 10, wherein a bump is extended from the second radiation conductor to adjust the operation frequency of the second radiation conductor.

20. The digital TV antenna of claim 10, wherein a bump is extended from the third radiation conductor to adjust the operation frequency of the third radiation conductor.

* * * * *